US005369459A

United States Patent [19]

Muchisky et al.

[11] Patent Number: 5,369,459

[45] Date of Patent: Nov. 29, 1994

[54] SOLUTION FILLING SYSTEM FOR A FILM PROCESSOR APPARATUS

[75] Inventors: Thomas P. Muchisky, St. Louis County, Mo.; Warren G. Fischer; Leonard Krystal, both of Kane County, Ill.

[73] Assignee: Fischer Industries, Inc., Geneva, Ill.

[21] Appl. No.: 771,737

[22] Filed: Oct. 4, 1991

[51] Int. Cl.[5] ..... G03D 3/02

[52] U.S. Cl. ..... 354/324; 354/331; 354/336

[58] Field of Search ..... 354/319–321, 354/323, 324, 331, 336–339

[56] References Cited

U.S. PATENT DOCUMENTS

| | | | |
|---|---|---|---|
| 119,753 | 10/1871 | Gale | 354/336 |
| 3,591,286 | 7/1971 | Yanagawa | 355/106 |
| 3,733,992 | 5/1973 | Stievenart et al. | 354/324 |
| 3,747,499 | 7/1973 | Foster | 354/324 |
| 4,324,479 | 4/1982 | Sachs | 354/319 |
| 4,515,456 | 5/1985 | Ferrante | 354/320 |
| 4,634,251 | 1/1987 | Jonker | 354/324 X |
| 4,941,008 | 7/1990 | Nakamura | 354/320 |
| 4,994,839 | 2/1991 | Yamakoshi | 354/322 |

*Primary Examiner*—D. Rutledge

*Attorney, Agent, or Firm*—Polster Polster Lucchesi

[57] ABSTRACT

The front-filling system consists of a pair of fill buckets located on the front of the processor housing. The fill buckets are connected to the internal solution tanks by fill tubes such that fluid in the fill buckets will be delivered to the solution tanks as solution is added during filling or replenishment. The fill buckets are provided with movable lids, to minimize evaporation and accumulation of debris, and the fill buckets are physically separated to prevent cross-contamination during the filling process. The fill buckets, or portions thereof, may be made of transparent material to aid in observing solution levels and solution condition. The fill buckets are positioned and sized to allow for easy filling and replenishment, and for easy observation of solution levels and solution condition without removal of top lids or top housings. The fill buckets each have front over-flow sluices, to eliminate any possibility of overflow within the interior solution tanks.

19 Claims, 1 Drawing Sheet

SOLUTION FILLING SYSTEM FOR A FILM PROCESSOR APPARATUS

BACKGROUND OF THE INVENTION

This invention relates, generally, to automatic film, processor apparatuses and, more particularly, to an improved solution filling system for such devices.

As is known in the art, in the typical film processor apparatus, the film is conveyed through the processor tanks in either a horizontal, vertical or serpentine path by spaced pairs of transport rollers, or between mesh-web carrier belts. As the film is conveyed through the apparatus, it is sequentially immersed in a developer solution, a fixer solution and water. Thereafter, the film is dried and dispensed from the apparatus.

The developer and fixer solutions and water are contained in separate tanks located in the processor housing. In the horizontal path apparatus, the liquids are pumped from the tanks into roller racks located above the tanks, thereby to contact the film as it passes through the roller racks. The liquids drain from the roller racks back into the tanks, such that the liquids are continuously recirculated. In the vertical path, and the serpentine path devices, the transport rollers or mesh-web carrier belts convey the film directly into the tanks where the film is submerged in the liquids. As will be apparent, in all types of film processing apparatus, the liquid levels in the tanks will gradually diminish as the liquids wet the film and as the liquids evaporate. As a result, it is necessary for the apparatus operator to fill all tanks initially, once monthly for example, and then, to replenish the liquids periodically. In some types of processor apparatus, this replenishment is accomplished automatically, by the use of sensing and pumping systems or by gravity-feed systems employing overhead-mounted inverted jugs. These automatic replenishment systems tend to be either expensive or prone to operational problems, or both.

In the known non-automatic-replenishment processors, the developer solutions and fixer solutions are replenished by manually removing the top lid or upper housing of the apparatus, to expose the tanks therein, in order to visually observe the amount of replenishment required, and in order to visually observe the condition of the solutions (i.e. the color of each is an indication of solution efficacy). Developer solutions and fixer solutions are then added to their respective tanks by lifting jugs of each solution above the apparatus, and pouring solutions down into the respective tanks. This same procedure is also required when initially filling the tanks in automatic-replenishment processor apparatus, and after each monthly draining and cleaning. Water is normally fed directly into the water tank via plumbing connections from a water tap.

Removal of the top lid or upper housing is somewhat time consuming and cumbersome, but the far more critical problems involved in initial filling and manual replenishment are: (1) lifting of the jugs over the apparatus is difficult, due to the weight of the solutions in the jugs, and; (2) it is very difficult to pour the solutions into their respective tanks without some degree of splashing, and developer and fixer solutions are highly incompatible, such that the splashing of even small amounts of fixer into the developer tank contaminates the developer, causing major processing problems in machine operation.

Thus, an improved filling system for the manual filling of, and replenishment of, developer and fixer solutions in automatic film processor apparatuses is desired.

One object of this invention is to provide a film processor which is easily filled and replenished with film developing and fixing solutions.

Another object is to provide such a film processor wherein the levels of and the condition of the solutions within the processor are easily observed.

Another object is to provide such a film processor which substantially reduces the possibility of cross-contamination of the film developing and fixing solutions and to eliminate any possibility of overflowing of the solutions within the interior of the processor.

Other objects will become apparent to those skilled in the art upon a review of the following disclosure and accompanying drawings.

SUMMARY OF THE INVENTION

The filling system of the invention overcomes the above-noted shortcomings of the prior art and consists of a pair of fill buckets conveniently located on the front of the processor apparatus. The fill buckets are connected to the solution tanks by fill tubes, such that solution in the fill buckets are delivered to the respective solution tanks within the apparatus as the solution is manually added to the fill buckets. The fill buckets are physically separated from each other so that splashing of one solution into the other is virtually impossible. Moreover, the level of, and condition of, the solutions is readily visible to the operator, without requiring removal of the processor top lids or upper housing. Equally important, the manual addition of solutions to the fill buckets is easy, due to their front location and lower height. The fill buckets are provided with operable lids to minimize solution evaporation and to prevent debris or contaminants from entering the fill-buckets, and with solution-level indicators and with an overflow device. The overflow device insures that solution overflow within the apparatus is virtually impossible.

DESCRIPTION OF THE PREFERRED EMBODIMENT

Figure 1:
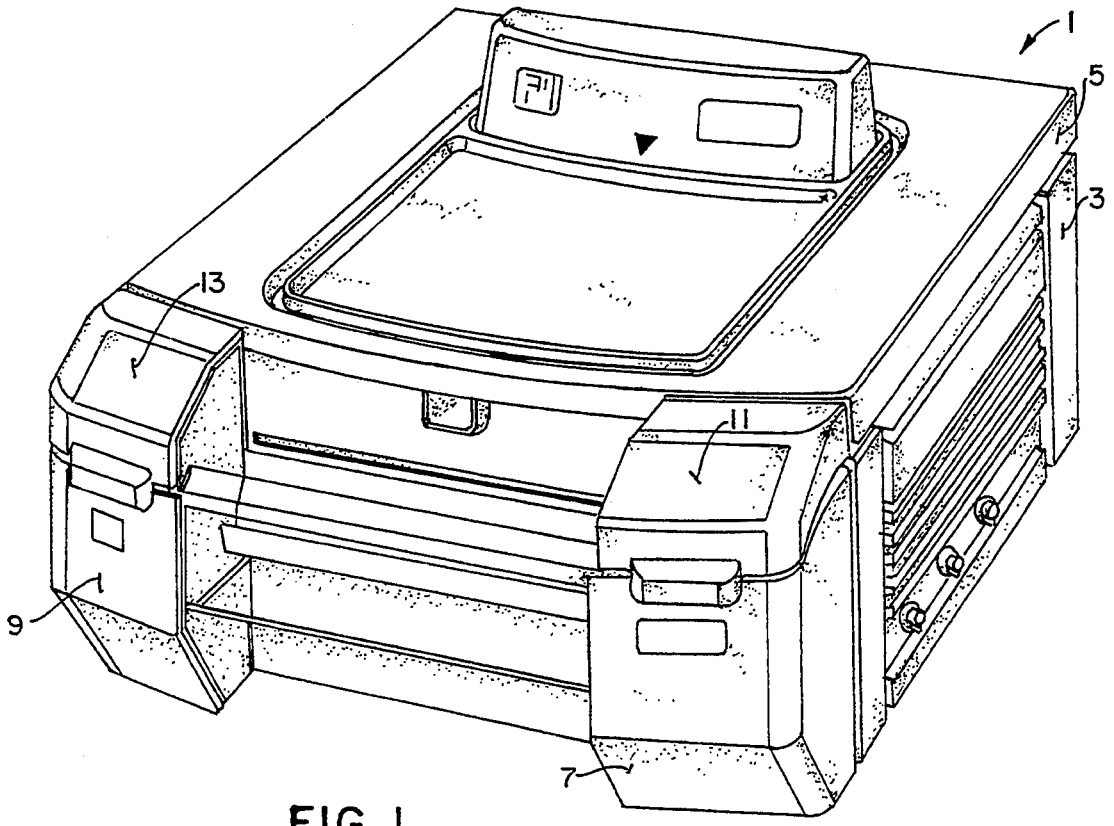
FIG. 1 is a perspective view of one illustrative embodiment of film processor apparatus of the invention.

Referring more particularly to FIG. 1, the automatic film processor of the invention is shown generally at 1. Apparatus 1 consists of a lower housing 3 containing the solution tanks, transport system, pumps, motors and controls as is known in the art. A removable upper housing 5 covers the lower housing 3 to isolate the internal workings of the film processor apparatus from the surrounding environment.

Fill buckets 7 and 9 are mounted on the front of lower housing 3 for receiving developer solution and fixer solution, respectively. Fill buckets 7 and 9 are covered by movable lids 11 and 13, respectively, that allow access to the fill buckets during the solution filling operation, and during the solution replenishment operation. Except during solution filling or replenishing operations, lids 11 and 13 remain closed to reduce the amount of contaminants which may enter the solutions and to reduce evaporation of the solutions.

Figure 2:
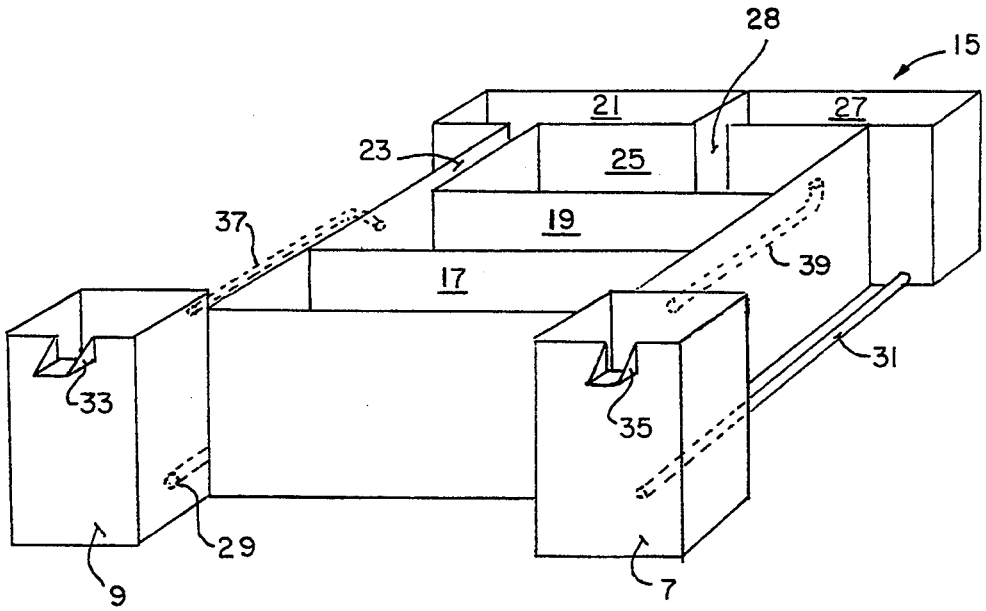
FIG. 2 is a perspective view of a portion of the interior of the apparatus showing the solution tanks and fill buckets.

Referring to FIG. 2, the internal tank structures of the apparatus 1 is shown consisting of a molded plastic tank assembly 15. The solution filling system disclosed hereinafter is incorporated in a novel film processor apparatus, portions are of which are described in U.S. Ser. No. 635,281, filed Dec. 28, 1990, U.S. Ser. No. 641,459, filed Jan. 14, 1991, U.S. Ser. No. 771,213, filed Oct. 4, 1991, entitled Top Drop Film Feed System, and U.S. Ser. No. 771,205, filed Oct. 4, 1991, entitled Improved Switching System For Film Processor. The disclosures of each of these related applications are entended to be incorporated herein by reference. The roller system for conveying the film through the apparatus, the control system and the pump system have been omitted to more clearly illustrate applicant's invention. It will be appreciated by one skilled in the art that the use of the filling system of the invention is not limited to any particular film processor apparatus construction. Specifically, tank assembly 15 includes a first tank 17 for retaining a supply of water. Water is supplied directly to tank 17 from, for example, a building's water supply such that filling of and replenishment of the water can be easily accomplished.

Tank Assembly 15 also includes a fixer solution tank 19 for retaining a supply of fixer solution. Reserve tank 21 holds a further supply of fixer solution that is continuously available to tank 19 via passageway 23.

A developer solution tank 25 for retaining a supply of developer solution is also formed in tank assembly 15. Reserve tank 27 holds a further supply of developer solution that is continuously available to tank 25 via passageway 28.

Fill buckets 7 and 9 are spaced from and external of tanks 21 and 27, but within the processor apparatus as has been previously described with respect to FIG. 1. The fill buckets are connected to reserve tanks 21 and 27 by fill tubes 29 and 31 respectively. Thus, solution added to fill buckets 7 and 9 will be delivered to solution tanks 19 and 25 via reserve tanks 21 and 27 and passageways 23 and 28. It should be noted that fill tubes 31 and 29 could be connected directly to tanks 25 and 19, respectively, if so desired.

Fill buckets 7 and 9 have overflow sluices 33 and 35, respectively, on the fronts thereof. Overflow sluices 33 and 55 are positioned on fill buckets 7 and 9 so that the fluid levels in the fill buckets will overflow the front of the fill buckets prior to overflowing any of the interior tanks to prevent overflowing of any solutions within the interior of the processor, and cross-contamination of the developer and fixer solutions within film processor 1. Fill buckets 7 and 9 are also preferably spaced from each other to reduce the risk of cross-contamination of the fixer and developer solutions which may otherwise occur during filling or replenishing operations.

In a preferred embodiment, fill buckets 7 and 9 are assembled at a specific level with respect to the tank assembly 15 so that the fluid level in the fill buckets will reflect the fluid level in the solution tanks. Thus, as solution is dissipated during the film developing operation, the receding solution level in the solution tanks will be reflected by a corresponding drop of the solution levels in the fill buckets. The solution levels within the interior tanks of the apparatus, and the color and condition of the solutions in the various interior tanks can accordingly be monitored simply by observing the solution levels and condition within the fill buckets. A portion of the fill buckets can be made of transparent material to facilitate this operation. Finally, the interior tanks can be initially filled, or solutions therein can be replenished simply by adding more solution to the fill buckets, thereby avoiding the need to remove upper housing's cover or top lid.

Numerous variations within the scope of the appended claims, will be apparent to those skilled in the art in view of the appended claims. Merely by way of example, secondary return tube 37 and 39, shown in phantom, between the internal tanks end the fill buckets may be used in other embodiments of our invention to enhance solution condition monitoring, if desired. Likewise, flow varying means may be employed between the tank 27 and 25 or 21 and 19, to ensure uniformity of solution condition in each section of the film processor of our invention. While the filling system of the invention has been described in detail with particular reference to the drawing figures shown, it is to be understood that the foregoing description is offered merely by way of example and that the invention is to be limited in score only by the appended claims.

Having thus described the invention, what is claimed and desired to be secured by Letters Patent is:

1. A film processor apparatus, comprising:
   a) an internal tank assembly;
   b) at least one solution tank for retaining a supply of solution;
   c) a reserve tank in fluid communication with said solution tank for holding a reserve of said solution;
   d) at least one solution receiving tank, separate from said reserve tank, for receiving a supply of solution for said at least one solution tank, said at least one solution receiving tank being separate from said internal tank assembly; and
   e) means for providing fluid communication between said at least one solution receiving tank and said at least one solution tank.

2. The developer apparatus according to claim 1 further including a second solution tank, and a second solution receiving tank, said solution receiving tanks each defining one fill bucket for each said solution tank.

3. The film processor apparatus according to claim 2, wherein said fill buckets include a movable lid.

4. The film processor apparatus according to claim 2 further including means for monitoring the level and condition of said solution within said film processor.

5. The film processor apparatus according to claim 4 wherein said solution level and condition monitoring means includes said fill buckets; said solution level and condition within said fill buckets being visible through at least a portion of said fill buckets.

6. The film processor apparatus according to claim 2 further including means for preventing cross-contamination of said solutions carried by said film processor during filling or replenishment of said solutions.

7. The film processor apparatus according to claim 1, wherein said means for providing fluid communication includes a fill tube extending from fill buckets into the interior of the internal tank assembly and communicating with said at least one solution tank.

8. The film processor of claim 1 further including means for monitoring the level of solution within said at least one solution receiving tank, said monitoring means including a fill bucket, said fill bucket including means for determining said solution level and condition.

9. The film processor of claim 8 wherein said solution level determining means includes a portion of said fill bucket, said solution being visible through at least a portion of said fill bucket.

10. A film processor apparatus, comprising:
a) an internal tank assembly;
b) a first and a second solution tank for retaining a supply of solution;
c) a reserve tank in fluid communication with said solution tank for holding a reserve of said solution:
d) fill buckets, separate from said reserve tank, for receiving a supply of solution for each said solution tank, said fill buckets being separate from said internal tank assembly;
e) means for providing fluid communication between said fill buckets and said solution tanks; and
f) means for monitoring the level and condition of said solution within said film processor, said fill buckets being mounted such that the level of solution in said fill buckets corresponds to the level of solution in said at least one solution tank.

11. A film processor apparatus, comprising:
a) an internal tank assembly;
b) at least one solution tank for retaining a supply of solution;
c) a fill bucket for receiving a supply of solution for said at least one solution tank, said fill bucket being separate from said internal tank assembly; and
d) means for providing fluid communication between said solution receiving means and said at least one solution tank including a fill tube extending from said fill buckets into the interior of the internal tank assembly and communicating with said at least one solution tank; said fill tube communicating with a reserve tank, said reserve tank being in communication with said at least one solution tank.

12. The film processor apparatus according to claim 11, wherein the level and condition of solution within said fill bucket is monitored by observation of the level of fluid within said fill bucket.

13. A film processor apparatus, comprising:
a) an internal tank assembly;
b) a first and a second solution tank for retaining supplies of solutions;
c) means, separate from said internal tank assembly, for receiving a supply of solution for each said solution tank, said solution receiving means including one fill bucket for each said solution tank;
d) means for providing fluid communication between said solution receiving means and said at least one solution tank; and
e) means for preventing cross-contamination of said solutions carried by said film processor during filling or replenishment of said solutions; said cross-contamination preventing means including overflow sluices on said fill buckets, such that solutions in the fill buckets will overflow said fill buckets prior to overflowing said solution tanks in the internal tank assembly.

14. The film processor according to claim 13 wherein said cross-contamination preventing means includes said fill buckets, said fill buckets being spaced from one another.

15. A film processor comprising:
a) an internal tank assembly;
b) at least one solution tank for retaining a supply of solution;
c) a fill bucket in communication with said solution tank, for receiving a supply of solution for said at least one solution tank, said fill bucket being located separate from said internal tank assembly; and
d) means for monitoring the level of solution within said solution tank, said monitoring means including said fill bucket, said fill bucket including means for determining said solution level and condition, said bucket being positioned such that the level of solution in said fill bucket corresponds to the level of solution in said solution tank.

16. A film processor comprising a tank assembly including two solution tanks, means, separate from said solution tanks, for filling said solution tanks, and means for preventing cross-contamination of said solutions in said solution tanks comprising open solution tank overflow prevention means which allow said solutions to overflow said filling means before said solution tanks overflow.

17. The film processor of claim 16 wherein said cross-contamination preventing means further includes said solution tank filling means, there being one filling means for each said solution tank, said filling means being spaced from each other.

18. A film processor comprising a tank assembly including two solution tanks, means, separate from said solution tanks, for filling said solution tanks, and means for preventing cross-contamination of said solutions in said solution tanks comprising open solution tank overflow prevention means; said solution tank overflow prevention means comprising overflow sluices in said filling means, said sluices being positioned to allow said solutions to flow out of said tank assembly before said solution tanks overflow.

19. A film processor apparatus, comprising:
a) a housing defining an internal tank assembly having at least one solution tank for retaining a supply of solution and a reserve tank in fluid communication with said solution tank for holding a reserve of said solution;
d) means, externally of said housing, for receiving a supply of solution for said at least one solution tank: and
e) means for providing fluid communication between said solution receiving means and said at least one solution tank.

* * * * *